US007338543B2

(12) United States Patent
Kikawa

(10) Patent No.: US 7,338,543 B2
(45) Date of Patent: Mar. 4, 2008

(54) GAS MIXING APPARATUS

(75) Inventor: Shunjiro Kikawa, Kariya (JP)

(73) Assignee: Denso Corporation, Kariya (JP)

( * ) Notice: Subject to any disclaimer, the term of this patent is extended or adjusted under 35 U.S.C. 154(b) by 564 days.

(21) Appl. No.: 11/047,612

(22) Filed: Feb. 2, 2005

(65) Prior Publication Data

US 2005/0172547 A1 Aug. 11, 2005

(30) Foreign Application Priority Data

Feb. 5, 2004 (JP) ..... 2004-029708
Dec. 7, 2004 (JP) ..... 2004-354636

(51) Int. Cl.
*B01F 5/06* (2006.01)
*B01F 3/02* (2006.01)

(52) U.S. Cl. ..... 48/180.1; 366/336

(58) Field of Classification Search ..... 48/180.1, 48/189.5, 189.4, 187; 366/336, 337, 340
See application file for complete search history.

(56) References Cited

U.S. PATENT DOCUMENTS 4,425,898 A * 1/1984 McLean ..... 123/527
4,813,788 A * 3/1989 Shih et al. ..... 366/337
5,816,049 A * 10/1998 Joshi ..... 60/737
7,097,347 B2 * 8/2006 Vanden Bussche et al. ..... 366/165.1

FOREIGN PATENT DOCUMENTS

JP A 05-212259 8/1993

OTHER PUBLICATIONS

Static Mixer by Noritake Company Limited; pp. 3, 11 & 30 (w/partial English translation). Date Unknown but prior to Feb. 2, 2005.

* cited by examiner

*Primary Examiner*—Walter D. Griffin
*Assistant Examiner*—Huy-Tram Nguyen
(74) *Attorney, Agent, or Firm*—Oliff & Berridge, PLC

(57) ABSTRACT

A static mixer includes a plurality of mixing elements disposed parallel to each other and arrayed annularly to define an inner cylindrical space surrounded by these mixing elements. Each mixing element has stationary vanes disposed in a circular passage. A blower supplying the air to the static mixer is entirely or partly accommodated and fixed in the inner cylindrical space of the static mixer. The static mixer and the blower are disposed parallel to each other. The overall length of the fuel mixture generating apparatus can be shortened.

8 Claims, 4 Drawing Sheets

GAS MIXING APPARATUS

CROSS-REFERENCE TO RELATED APPLICATION

This application is based upon and claims the benefit of priority from earlier Japanese Patent Application No. 2004-29708 filed on Feb. 5, 2004 and the Japanese Patent Application No. 2004-354636 filed on Dec. 7, 2004 so that the descriptions of which are incorporated herein by reference.

BACKGROUND OF THE INVENTION

The present invention relates to a gas mixing apparatus used for uniformly mixing two kinds of gases, and is preferably applicable to a fuel gas combustion apparatus which generates a fuel mixture of fuel gas and air.

The Japanese Patent Application Laid-open No. 05-212259 (1993) discloses a static mixer including numerous rotary blades provided on the surfaces of two combined cones connected at their bottoms. This conventional static mixer provides numerous flow passages extending on the conical surfaces of two cones from one end (i.e. top of one cone) to the other end (i.e. top of the other cone), to produce a uniform mixture of a plurality of gases.

However, according to the above-described conventional gas mixing apparatus, the gases must be supplied to the pinnacle of one cone. To this end, the supply passage of the gases is narrowed (i.e. has a smaller diameter) in the vicinity of the gas inlet of the gas mixing apparatus. This arrangement increases the pressure loss.

In general, a blower or a comparable gas supplying device is provided to supply the gases to the gas mixing apparatus and is disposed in series with the gas mixing apparatus at the upstream side of this gas mixing apparatus. The mixing apparatus including the serially connected gas supplying means is long in the length in the gas flowing direction. When the gas mixing apparatus is assembled with a combustion apparatus or other apparatus, the overall size of the assembled apparatus body becomes larger.

SUMMARY OF THE INVENTION

In view of the above-described problems, the invention has an object to provide a gas mixing apparatus which includes a gas supplying device incorporated in an inner space of the gas mixing apparatus to shorten the length of the apparatus in the gas flowing direction.

In order to accomplish the above and other related objects, the present invention provides a gas mixing apparatus including a mixing means, a first gas supplying means, and a second gas supplying means. The mixing means, having a gas inlet at one end side and a gas outlet at the other end side, produces a fuel mixture of a first gas and a second gas. The first gas supplying means supplies the first gas to the gas inlet of the mixing means. The second gas supplying means supplies the second gas to the gas inlet of the mixing means. The mixing means includes a plurality of mixing elements disposed parallel to each other and arrayed annularly to define an inner cylindrical space surrounded by these mixing elements. Each mixing element has stationary vanes disposed in a circular passage. The fuel mixture of the first gas and the second gas is produced from the gas outlet of the mixing means. The first gas supplying means is disposed outside the mixing means. And, the second gas supplying means is accommodated entirely or partly in the inner cylindrical space of the mixing means.

In a conventional gas mixing apparatus, the mixing means occupies the entire cross-sectional area in the gas flowing direction. In other words, the entire cross-sectional area of the conventional gas mixing apparatus in the gas flowing direction is a gas passage. Accordingly, the gas supplying means for supplying the gas to the mixing means must be disposed in series with the mixing means in a gas flowing direction. Accordingly, the overall length of the gas mixing apparatus is large.

On the other hand, according to the gas mixing apparatus of the present invention, the mixing means includes a plurality of mixing elements disposed parallel to each other and arrayed annularly to define an inner cylindrical space surrounded by these mixing elements. Each mixing element has stationary vanes disposed in a circular passage. The second gas supplying means is accommodated entirely or partly in the inner cylindrical space of the mixing means. The mixing means and the second gas supplying means are completely or partly overlapped with each other in the gas flowing direction. Thus, the overall length of the gas mixing apparatus is short.

The second gas flows into the mixing means from the inner side of the gas inlet. Accommodating the second gas supplying means completely or partly in the inner cylindrical space of the mixing means enables the second gas supplying means to easily supply the second gas to the inlet of the mixing means.

According to the gas mixing apparatus of the present invention, it is preferable that the second gas supplying means is a motor driven blower. The motor driven blower is equipped with a rotary blade. In general, the motor driven blower has a circular outer shape. Thus, the motor driven blower can be easily and effectively accommodated in the inner cylindrical space of the mixing means.

According to the gas mixing apparatus of the present invention, it is preferable that the mixing means has a separating plate provided at the gas inlet for separating an introducing passage of the first gas from an introducing passage of the second gas. This arrangement can prevent the first gas from flowing into the second gas supplying means and also can prevent the second gas from flowing into the first gas supplying means, at the upstream side of the mixing means.

According to the gas mixing apparatus of the present invention, it is preferable that the mixing means has a flow regulating plate provided at a downstream portion of the gas outlet. The flow regulating plate includes numerous fine passages. The fuel mixture exits out of the gas mixing apparatus through the flow regulating plate. According to a preferable arrangement of the gas mixing apparatus of the present invention, the gas outlet of the mixing means has a toroidal configuration. The fuel mixture of the first gas and the second gas forms a toroidal stream.

On the other hand, it is desirable to form a circular stream of fuel mixture having a uniform flow speed everywhere in the circular cross-section thereof and then supply this circular stream of fuel mixture into the apparatus, such as a burner, which utilizes the fuel mixture supplied from the gas mixing apparatus. However, simply converting the toroidal stream of the fuel mixture produced from the mixing means into the columnar stream is not preferable in that the flow speed of the converted columnar stream may become locally faster or slower.

In this respect, the flow regulating plate according to the preferred arrangement of the present invention is capable of acting as a damper which reduces the flow resistance in a region where the velocity of flow is small and, to the contrary, increases the flow resistance in a region where the velocity of flow is large. Accordingly, the fuel mixture having passed through the flow regulating plate can flow with a uniform speed everywhere in the circular cross-sectional area thereof.

According to the gas mixing apparatus of the present invention, it is preferable that the flow regulating plate is a porous air-permeable solid member. With this arrangement, it becomes possible to easily equalize the flow speed of the fuel mixture everywhere in the circular cross-sectional area after the fuel mixture passed the flow regulating plate. Furthermore, the porous air-permeable solid member is generally made of ceramics, sintered metal or the like. The porous air-permeable solid member has fine passages arranged in a complicated manner to communicate with each other. Accordingly, when the fuel mixture of the mixing means passes the porous air-permeable solid member, the first gas and the second gas are further stirred or mixed well. The uniformity of the fuel mixture improves.

According to the gas mixing apparatus of the present invention, it is preferable that the first gas is hydrogen gas and the second gas is air. The gas mixing apparatus of the present invention can be preferably applied to a combustion apparatus using the hydrogen fuel, such as a catalytic combustion heater. The catalytic combustion heater can be downsized.

According to the gas mixing apparatus of the present invention, it is preferable that at least one of the passage and the stationary vanes has a water repellent surface. When at least one of the first and second gases contains waterdrops or any other moisture components, the water possibly adhere on at least one of the passage and the stationary vanes when the first gas and the second gas pass the mixing means. If a great amount of water adheres on the passage or on the stationary vanes, the effective cross-sectional area of the passage will decrease and the flow resistance of the passage will increase. Accordingly, a required fuel mixture flow rate will not be obtained. However, the water components contained in the gas do not adhere on the water repellent surface of the passage or the stationary vane, and accordingly the water smoothly flows along the surface and will soon go out of the passage. With this arrangement, it becomes possible to prevent the waterdrops contained in the gas from remaining in the passage. The flow resistance of the passage does not increase.

According to the gas mixing apparatus of the present invention, it is preferable that a collecting means is provided in the vicinity of the gas outlet of the mixing means for collecting water, and a draining means is provided for draining the water collected by the collecting means to the outside. In general, the gas mixing apparatus is assembled with the apparatus which utilizes the fuel mixture produced from the gas mixing apparatus. Therefore, the waterdrops contained in at least one of the first and second gases, i.e. the waterdrops contained in the fuel mixture produced from the gas mixing apparatus, become foreign particles or impurities when introduced into the apparatus utilizing the fuel mixture. The collecting means according to the preferred arrangement of the present invention can collect the water if it flows out of the passage without adhering on the passage and the stationary vanes. Thus, the waterdrops contained in the fuel mixture are surely removed out of the gas mixing apparatus. The draining means can discharge the collected water to the outside. Accordingly, when a large amount of water is stored in the collecting means, the draining means discharges the collected water to the outside. The water collecting function of the collecting means is always and stably maintained when the gas mixing apparatus is operating.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENTS

The present invention relates to a gas mixing apparatus attached to or assembled with a catalytic combustion heater. The gas mixing apparatus produces a fuel mixture of hydrogen gas and air. The catalytic combustion heater uses the produced hydrogen fuel mixture.

First Embodiment

Figure 1:
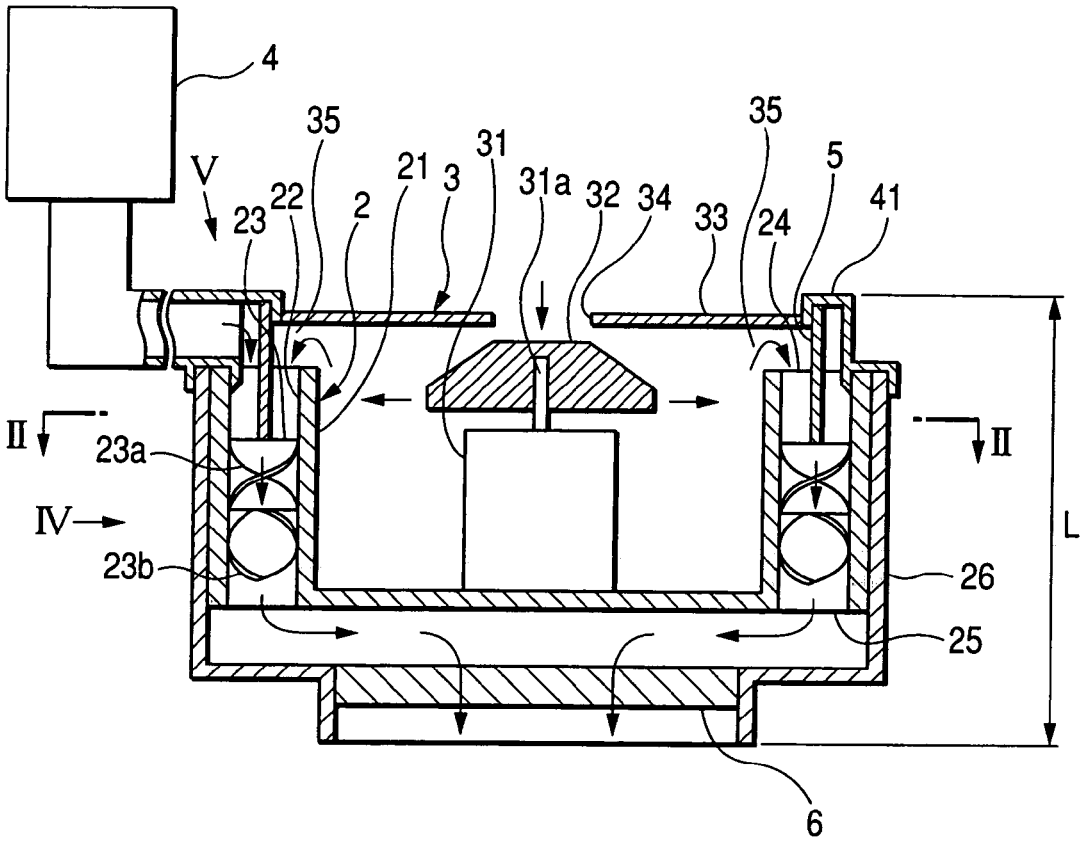
FIG. 1 is a partly cross-sectional view showing an overall arrangement of a fuel mixture generating apparatus in accordance with a first embodiment of the present invention.
Figure 2:
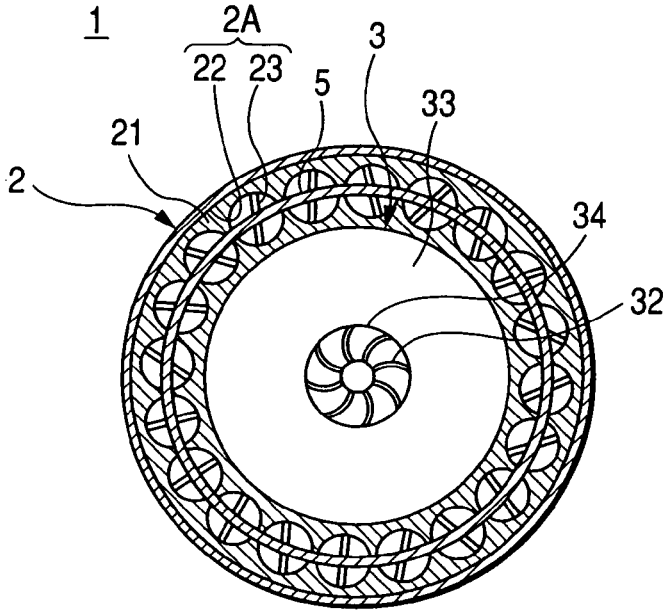
FIG. 2 is a cross-sectional view showing the fuel mixture generating apparatus in accordance with the first embodiment of the present invention, taken along a line II-II of FIG. 1.
Figure 3:
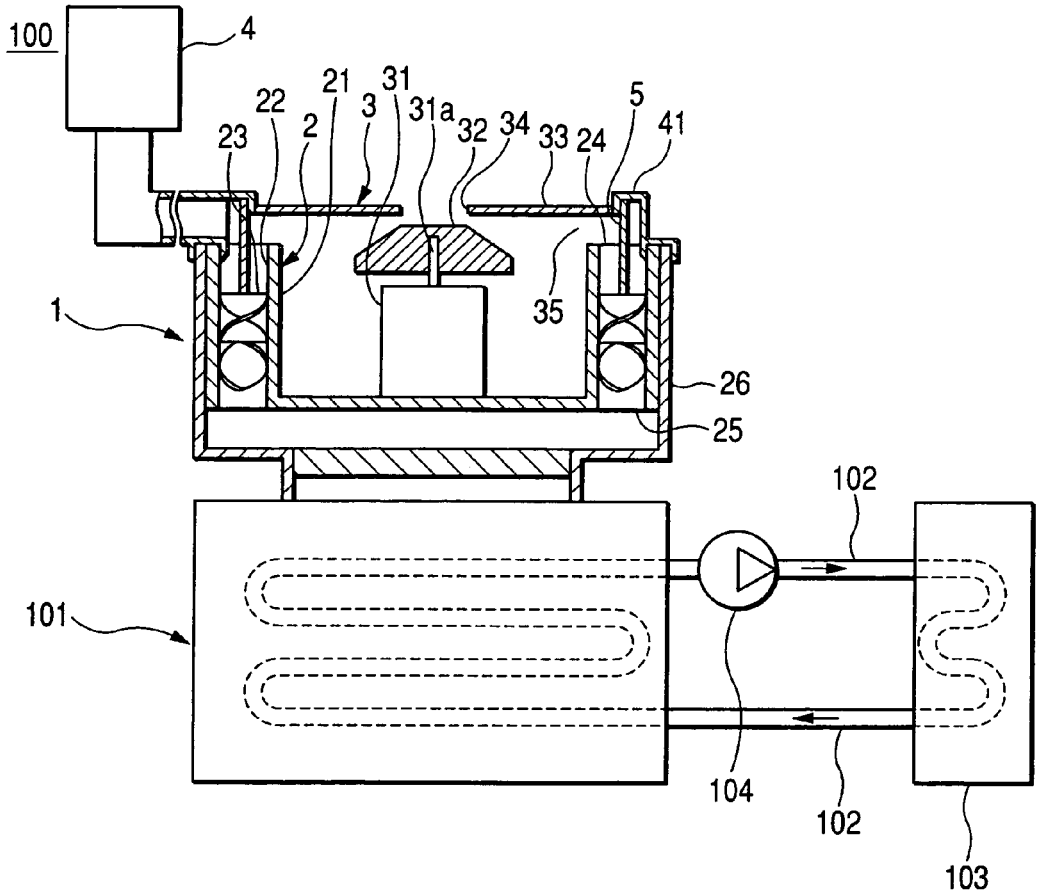
FIG. 3 is a partly cross-sectional view showing an arrangement of a catalytic combustion heater incorporating the fuel mixture generating apparatus in accordance with the first embodiment of the present invention.
Figure 4:
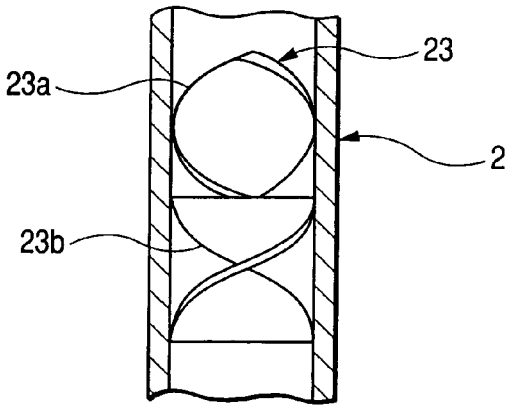
FIG. 4 is a cross-sectional side view showing a static mixer of the fuel mixture generating apparatus seen from the direction IV of FIG. 1.
Figure 5:
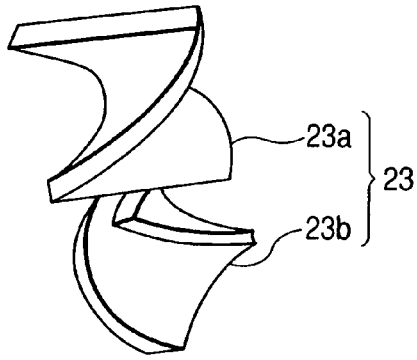
FIG. 5 is a perspective view showing a fin of the static mixer seen from the direction V of FIG. 1.

FIG. 1 is a cross-sectional view showing an overall arrangement of a fuel mixture generating apparatus 1 in accordance with a first embodiment of the present invention. FIG. 2 is a cross-sectional view of the fuel mixture generating apparatus 1 taken along a line II-II of FIG. 1. FIG. 3 is a partly cross-sectional view showing an arrangement of a catalytic combustion heater 100 incorporating the fuel mixture generating apparatus 1 in accordance with the first embodiment of the present invention. FIG. 4 is a cross-sectional side view showing a static mixer of the fuel mixture generating apparatus 1 seen from the direction IV of FIG. 1. FIG. 5 is a perspective view showing the arrangement of a fin 23 of the static mixer seen from the direction V of FIG. 1.

The catalytic combustion heater 100 is a device which causes the combustion of hydrogen gas. The generated heat is used in the air-conditioning apparatus. The catalytic combustion heater 100, as shown in FIG. 3, includes the fuel mixture generating apparatus 1, a catalytic combustion heat exchanger 101, a heater core 103, a pipe arrangement 102, and a pump 104. The fuel mixture generating apparatus 1 produces a fuel mixture of hydrogen gas and air and supplies the produced fuel mixture to the outside (i.e. to an associated device). According to this embodiment, the hydrogen gas serves as a first gas and the air serves as a second gas. The catalytic combustion heat exchanger 101, including an oxidation catalyst, causes a catalytic reaction of hydrogen gas and air (more specifically, oxygen) and transfers the generated heat to a heat carrier, such as water, for performing the heat exchange. The heat carrier conveys the heat generated from the catalytic combustion heat exchanger 101 to the heater core 103. The heater core 103 radiates the received heat to the outside. The pump 104 forcibly circulates the heat carrier in the heat carrier pipe arrangement, 102 disposed between the catalytic combustion heat exchanger 101 and the heater core 103.

The fuel mixture generating apparatus 1 is a gas mixing apparatus according to the first embodiment of the present invention. The fuel mixture generating apparatus 1 is disposed at an upstream side of the catalytic combustion heat exchanger 101 in the catalytic combustion heater 100, as shown in FIG. 3. The fuel mixture generating apparatus 1 produces a fuel mixture of hydrogen gas and air, and supplies the produced fuel mixture to the catalytic combustion heat exchanger 101.

The arrangement of the fuel mixture generating apparatus 1 in accordance with the first embodiment of the present invention will be explained hereinafter. The fuel mixture generating apparatus 1 according to the first embodiment of the present invention includes a static mixer 2, a hydrogen gas supplying apparatus 4, and a blower 3, as shown in FIG. 1. The static mixer 2 allows hydrogen gas and air to pass inside thereof to produce a uniform fuel mixture of hydrogen gas and air. The hydrogen gas supplying apparatus 4 supplies the hydrogen gas to an upstream side of the static mixer 2. The hydrogen gas supplying apparatus 4 is a first gas supplying means of the present invention. The hydrogen gas is a first gas of the present invention. The blower 3 supplies the air to the upstream side of the static mixer 2. The blower 3 is a second gas supplying means of the present invention. The air is a second gas of the present invention.

The static mixer 2, serving as mixing means of the present invention, includes a cylindrical body 21 with a bottom. Numerous circular passages 22, each being a through-hole extending in an axial direction of the body 21, are provided in parallel with each other. Respective circular passages 22 are arranged annularly along an inner cylindrical wall of the body 21. Each passage 22 is provided with a fin 23 which consists of a plurality of stationary vanes inserted and fixed inside this passage. Namely, a set of passage 22 and fin 23 (i.e. combined stationary vanes) arranges a mixing element 2A. As shown in FIG. 2, numerous mixing elements 2A are arrayed in an annular shape and parallel to each other to form the static mixer 2.

The fuel mixture generating apparatus 1 of the first embodiment has a total of 20 mixing elements 2A. Furthermore, the static mixer 2 has a gas inlet provided at an opened end side of its cylindrical body and a gas outlet provided at the bottom side. FIG. 1 shows the gas inlet provided at the upper end of the static mixer 2 and the gas outlet provided at the lower end of the static mixer 2. Furthermore, the static mixer 2 has an inner cylindrical space surrounded by the mixing elements 2A arrayed annularly along the inner cylindrical wall of the body 21. The blower 3 is disposed in the inner cylindrical space of the static mixer 2, as shown in as shown in FIG. 1. The blower 3 supplies the air (i.e. second gas) into the static mixer 2.

According to the fuel mixture generating apparatus 1 of the first embodiment of this invention, the fin 23 consists of two (i.e. upper and lower) fin elements (i.e. combined stationary vanes) 23*a* and 23*b* which are disposed in series as shown in FIGS. 1 and 2. FIG. 5 shows the fin elements 23*a* and 23*b* each being made of a single curved plate having upper and lower edges being twisted relative to each other by 180 degrees. Respective fin elements 23*a* and 23*b* divide the passage 22 into two equivalent passages. The twist direction of the upper fin element 23*a* is clockwise, while the twist direction of the lower fin element 23*b* is counterclockwise. For example, the longitudinal size of each fin element 23*a* or 23*b* is 1.5 times as large as the diameter thereof.

This arrangement forces the fuel mixture of air and hydrogen gas flowing in the passage 22 to alternately change its flow direction between two opposite directions (i.e. clockwise and counterclockwise directions) according to the curvatures of respective fin elements 23*a* and 23*b*. Thus, the fuel mixture is subjected to sudden and frequent changes of the inertia force. As a result, the fuel mixture is stirred well due to the turbulence being thus caused. Furthermore, two serially disposed fin elements 23*a* and 23*b* are angularly offset at their contact edges by 90 degrees as shown in FIGS. 1 and 4. This arrangement surely divides the stream of the fuel (i.e. air and hydrogen) mixture into two, each time the fuel mixture passes respective fin elements 23*a* and 23*b*. The air and the hydrogen gas are sufficiently stirred and mixed in the process of passing in respective mixing elements 2A. As a result, the static mixer 2 produces a uniform fuel mixture of the air and the hydrogen gas. Although FIG. 1 shows only two fin elements (i.e. combined stationary vanes) 23*a* and 23*b*, it is possible to provide three or more fin elements alternately and serially disposed.

The blower 3, serving as the second gas supplying means of the present invention, is a motor driven blower used in the fuel mixture generating apparatus 1 according to the first embodiment of the present invention. The blower 3 includes an impeller 32 which is fixed to a drive shaft 31 a of the motor 31 and driven by the motor 31. The air is introduced from an intake port 34 and discharged to a discharge passage 35. The discharge passage 35 is a second gas introducing passage of the present invention. Namely, as shown in FIG. 1, the intake air flows along the arrow from the intake port 34 to the discharge passage 35 via the impeller 32. Furthermore, as shown in FIG. 1, the entire body of the blower 3 is accommodated and fixed in an inner cylindrical space of the static mixer 2. A front end and its periphery of the discharge passage 35 protrude from the inner cylindrical space of the static mixer 2.

In the fuel mixture generating apparatus 1 according to the first embodiment of the present invention, the blower 3 is a centrifugal blower as shown in FIG. 1. The hydrogen gas supplying apparatus 4, serving as the first gas supplying means for supplying the hydrogen (i.e. first gas) to the static mixer 2, is disposed at an outer side of the static mixer 2 as shown in FIG. 1. The hydrogen gas supplying apparatus 4 is an apparatus capable of controlling the hydrogen gas supplied into the static mixer 2 to an adequate value with reference to pressure, flow rate, temperature, or the like, as described later in more detail. Regarding a hydrogen supply source of the hydrogen gas supplying apparatus 4, it is, for example, possible to use the offgas obtained from the FC stack in a fuel cell system or use a part of hydrogen gas supplies to the FC stack.

The air impelled by the blower 3 flows into an inner cylindrical side of a gas inlet 24 of the static mixer 2 via the discharge passage 35, as shown in FIG. 1. Furthermore, the hydrogen gas of the hydrogen gas supplying apparatus 4 flows into an outer cylindrical side of the gas inlet 24 of the static mixer 2 via the hydrogen supply passage 41. The gas inlet 24 of the static mixer 2 has a separator 5. The separator 5 is a separating plate which separates the discharge passage 35 from the hydrogen supply passage 41 as shown in FIG. 1. The separator 5 separates the discharge passage 35 from the hydrogen supply passage 41 in the gas inlet 24 of the static mixer 2. Furthermore, the separator 5 extends into the passage 22 as shown in FIG. 1. As the front end of the separator 5 is positioned adjacent to the fin 23 in the passage 22, the hydrogen gas and the air merge with each other in the passage 22 of the static mixer 2.

With this arrangement, in the fuel mixture generating apparatus 1, it is possible to minimize the region (premixing region) where the fuel mixture of hydrogen gas and air is present. A flow regulating plate 6 is disposed at a downstream side (i.e. the lower side in FIG. 1) of a gas outlet 25 of the static mixer 2 as shown in FIG. 1. The flow regulating plate 6 is a porous air-permeable solid member, such as ceramics or sintered metal, configured into a disc shape. The flow regulating plate 6 has numerous fine passages arranged in a complicated manner to communicate with each other in the inside space thereof. Furthermore, the flow regulating plate 6 is fixed to and held by a casing 26 covering the outer side of the static mixer 2, as shown in FIG. 1. Accordingly, the fuel mixture of hydrogen gas and air exits out of the gas outlet 25 of the static mixer 2 and flows toward the flow regulating plate 6 along the casing 26 as indicated by the arrow in FIG. 1. After the fuel mixture of hydrogen gas and air passes the flow regulating plate 6, the fuel mixture flows into the catalytic combustion heat exchanger 101. The catalytic combustion heat exchanger 101 is located outside the fuel mixture generating apparatus 1 according to the first embodiment of the present invention.

According to the above-described fuel mixture generating apparatus 1 of the first embodiment of the present invention, the static mixer 2 includes a plurality of mixing elements 2A which are disposed parallel to each other and arrayed annularly to define an inner cylindrical space surrounded by these mixing elements 2A. Each mixing element 2A includes the fin 23 being inserted and fixed in the circular passage 22. The entire body of the blower 3 is accommodated and fixed in the inner cylindrical space of the static mixer 2. The blower 3 supplies the air (i.e. second gas) to the static mixer 2. More specifically, the motor 31, the impeller 32, the intake port 34, and other essential components are accommodated and fixed in the inner cylindrical space of the static mixer 2. Only the discharge passage 35 has a portion protruding outside the gas inlet 24 of the static mixer 2 (i.e. the upper side in FIG. 1).

According to the conventional gas mixing apparatus, the second gas supplying means and the static mixer must be disposed in series with each other. The overall length of the gas mixing apparatus, i.e. the length in the direction of gas flow, becomes longer. The size of the gas mixing apparatus increases.

On the contrary, the fuel mixture generating apparatus 1 according to the first embodiment of the present invention includes the blower 3 (i.e. the second gas supplying means) accommodated and fixed in the inner cylindrical space of the static mixer 2. In other words, the blower 3 and the static mixer 2 are disposes in parallel to each other. The overall length L (refer to FIG. 1) of the fuel mixture generating apparatus 1 is short.

Furthermore, the air discharged from the blower 3 flows into the static mixer 2 from the inner cylindrical side of the gas inlet 24 of the static mixer 2. The air passage extending from the blower 3 to the static mixer 2, i.e. the discharge passage 35, can be shorten. The pressure loss between the blower 3 and the gas inlet 24 of the static mixer 2 reduces. The hydrogen gas supplying apparatus 4, serving as the first gas supplying means of the present invention, is disposed outside the static mixer 2.

According to the first embodiment of the present invention, the fuel mixture generating apparatus 1 is assembled in the catalytic combustion heater 100. The hydrogen gas supplying apparatus 4 supplies the hydrogen gas (i.e. fuel) into the catalytic combustion heater 100. The hydrogen gas supplying apparatus 4 should be disposed at a safe place. The hydrogen gas supplying apparatus 4 should be suitable to the apparatus into which the fuel mixture generating apparatus 1 is incorporated. According to the first embodiment of the present invention, the hydrogen gas supplying apparatus 4 of the fuel mixture generating apparatus 1 fits to the catalytic combustion heater 100. The blower 3 (i.e. the second gas supplying means) and the static mixer 2 are parallel to each other. The overall length L of the fuel mixture generating apparatus 1 is short. The fuel mixture generating apparatus 1 can be easily assembled to an associated apparatus. The overall size of the apparatus incorporating the fuel mixture generating apparatus 1 can be decreased.

Furthermore, the above-described fuel mixture generating apparatus 1 in accordance with the first embodiment of the present invention includes the blower 3 serving as the air (i.e. the second gas) supplying means of the present invention. The blower 3 is driven by the motor. The motor driven blower 3 can easily control the rotational speed of the blower 3 and the flow rare of the air supplied into the static mixer 2. In other words, the blower 3 has the capability of easily controlling the temperature of the catalytic combustion heater 100. Furthermore, the above-described fuel mixture generating apparatus 1 in accordance with the first embodiment of the present invention includes the separator 5 (i.e. the separating plate) which is provided at the gas inlet 24 of the static mixer 2 to separate the hydrogen supply passage 41 from the discharge passage 35.

Furthermore, the separator 5 extends inward from the gas inlet 24 of the static mixer 2 and reaches the fin 23 disposed in the passage 22. With this arrangement, it becomes possible to prevent the air from entering into the hydrogen gas supplying apparatus 4 or prevent the hydrogen gas from leaking out of the blower 3. Furthermore, providing the separator 5 makes it possible to minimize the region (i.e. premixing region) where the fuel mixture of hydrogen gas and air is present. The hydrogen gas tends to easily react with the air due to its activity. The fuel mixture of hydrogen gas and air flows in the passage extending from the static mixer 2 to the catalytic combustion heat exchanger 101. Accordingly, shortening the distance of the passage in which the fuel mixture of hydrogen gas and air flows can improve the safety of the catalytic combustion heater 100.

Furthermore, the above-described fuel mixture generating apparatus 1 in accordance with the first embodiment of the present invention includes the flow regulating plate 6 disposed at the downstream side of the gas outlet 25 of the static mixer 2. The flow regulating plate 6 is a porous air-permeable solid member, such as ceramics or sintered metal, configured into a disc shape. The flow regulating plate 6 has numerous fine passages arranged in a complicated manner to communicate with each other in the inside space thereof. As the static mixer 2 has an annular shape, a toroidal stream of the fuel mixture of hydrogen gas and air is produced from the gas outlet 25 of the static mixer 2. This toroidal stream of the fuel mixture is converted into a columnar stream and then supplied into the catalytic combustion heat exchanger 101.

However, simply converting the toroidal stream into the columnar stream is not preferable in that the flow speed of the converted columnar stream may become locally faster or slower. On the other hand, to stabilize the catalytic reaction in the catalytic combustion heat exchanger 101, it is desirable to produce the fuel mixture whose flow rate is uniform everywhere in the cross-sectional area.

Hence, the fuel mixture generating apparatus 1 in accordance with the first embodiment of the present invention provides the flow regulating plate 6 which is capable of acting as a damper. More specifically, the flow regulating plate 6 has a function of reducing the flow resistance in a region where the velocity of flow is small and, to the contrary, increasing the flow resistance in a region where the velocity of flow is large. Accordingly, the fuel mixture having passed through the flow regulating plate 6 has a uniform flow speed everywhere in the circular cross-sectional area thereof. Furthermore, in the process of passing through the flow regulating plate 6, the fuel mixture of hydrogen gas and air can be further stirred and mixed well. The uniformity of the fuel mixture improves.

Second Embodiment

Figure 6:
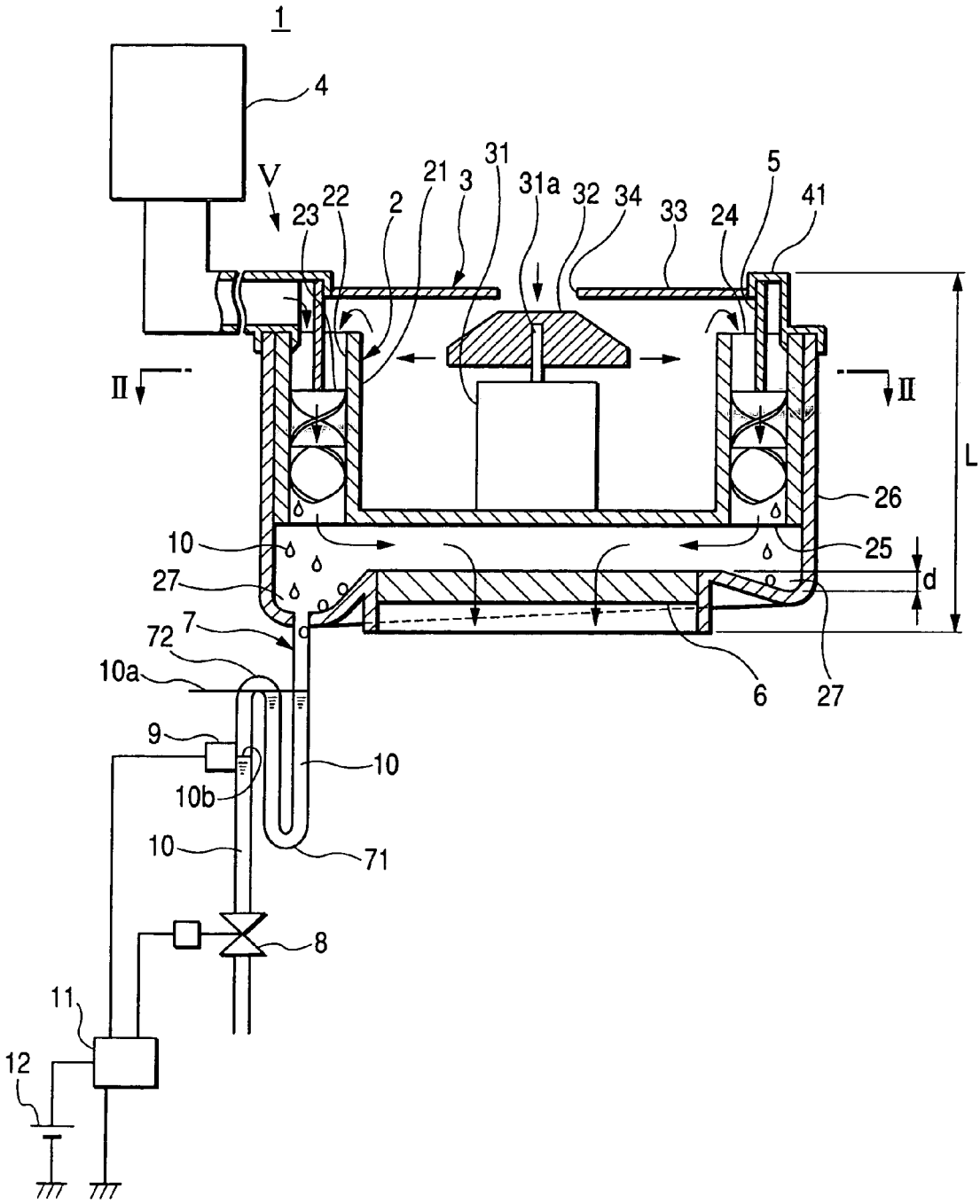
FIG. 6 is a cross-sectional view showing an overall arrangement of a fuel mixture generating apparatus in accordance with a second embodiment of the present invention.

FIG. 6 is a cross-sectional view showing an overall arrangement of the fuel mixture generating apparatus 1 in accordance with a second embodiment of the present invention. FIG. 6 shows the used condition of the fuel mixture generating apparatus 1. The fuel mixture generating apparatus 1 in accordance with the second embodiment of the present invention is different from the fuel mixture generating apparatus 1 in accordance with the first embodiment of the present invention in the following points. First, the mixing element 2A in the static mixer 2 is characteristic in that the inner wall surface of the passage 22 and the surface of the fin 23 have water repellency. Second, the casing 26 of the static mixer 2 has a collection groove 27 provided in the vicinity of the outlet of the mixing element 2A. The collection groove 27 is a collecting means of the present invention. The collection groove 27 is connected to a drain pipe 7. The drain pipe 7, which is a draining means of the present invention, discharges the water collected in the collection groove 27 to the outside. The open and close of the drain pipe 7 is controlled by an electromagnetic valve 8.

According to the fuel mixture generating apparatus 1 of the second embodiment of the present invention, the inner wall surface of the passage 22 and the surface of the fin 23 are covered with fluorocarbon resin films to give water repellency. For example, to form the fluorocarbon resin film, it is preferable to prepare the solution of incombustible fluoric solvent containing the fluorocarbon resin and then apply this solution on the inner wall surface of the passage 22 and on the surface of the fin 23. The air introduced into the fuel mixture generating apparatus 1 may contain waterdrops such as raindrops. When the air flows in the mixing element 2A, the waterdrops may adhere on the inner wall surface of the passage 22 and the surface of the fin 23. The waterdrops adhering on these surfaces will reduce the substantial cross-sectional area of respective passages 22 in the mixing elements 2A. There is the possibility that a required air flow rate may not be attained. Furthermore, there is the possibility that the waterdrops contained in the air may also adhere on the surface of the catalyst in the catalytic combustion heater 100 connected to the fuel mixture generating apparatus 1. The catalytic function will deteriorate.

According to the fuel mixture generating apparatus 1 of the second embodiment of the present invention, the inner wall surface of the passage 22 and the surface of the fin 23 in the mixing element 2A have water repellency. Therefore, it is possible to prevent the waterdrops from adhering on the inner wall surface of the passage 22 and on the surface of the fin 23. Furthermore, the collection groove 27 collects the waterdrops having passed through the mixing element 2A together with the air. Thus, the collection groove 27 has the function of preventing the waterdrops from flowing into the catalytic combustion heater 100.

The arrangement of the second embodiment can prevent the waterdrops contained in the air from reducing the substantial cross-sectional area of respective passages 22 in the mixing elements 2A. Thus, a required air flow rate is surely obtained. Furthermore, the arrangement of the second embodiment can prevent the waterdrops contained in the air from adhering on the catalytic surface. Thus, the catalytic function does not deteriorate. The fuel mixture generating apparatus 1 in accordance with the second embodiment of the present invention performs the following the drain action.

Hereinafter, the arrangement of the collection groove 27 and the drain pipe 7 will be explained. The collection groove 27 is formed at the bottom of the casing 26 as an annular recess opposing to the outlet 25, as shown in FIG. 6. The collection groove 27 has a depth "d" and a slope gradually increasing its depth, as shown in FIG. 6. The drain pipe 7 is connected to a portion where the depth "d" of the collection groove 27 is maximized. With this arrangement, almost all of the water collected by the collection groove 27 is surely guided into the drain pipe 7. The drain pipe 7 has two bent portions 71 and 72 as shown in FIG. 6. The electromagnetic valve 8 is attached to the downstream side of the bent portion 72 of the drain pipe 7. The electromagnetic valve 8 is for controlling the open and close of the drain pipe 7. Furthermore, a water level sensor 9 is provided at the downstream side of the bent portion 72 of the drain pipe 7 and at the upper side of the electromagnetic valve 8. The water level sensor 9 has the capability of detecting the water level position in the drain pipe 7. Both the electromagnetic valve 8 and the water level sensor 9 are electrically connected to a control circuit 11. The control circuit 11 is, for example, arranged by a microcomputer or the like and starts its operation when electric power is supplied from a battery 12. The control circuit 11 actuates the electromagnetic valve 8 based on the detection signal of the water level sensor 9 and controls the open and close of the drain pipe 7.

Next, the drain action performed by the collection groove 27 and the drain pipe 7 will be explained.

When the air passes through the mixing element 2A, the waterdrops 10 contained in the air will drop off the inner wall surface of the passage 22 and from the surface of the fin 23, because these surfaces have appropriate water repellency. The waterdrops 10 flow into the collection groove 27 as shown in FIG. 6, and then flow along the collection groove 27 toward the drain pipe 7 and enter into the drain pipe 7. Then, the waterdrops 10 gather in the bent portion 71 of the drain pipe 7. The water continuously gathering in the bent portion 71 will reach the water level position 10*a* shown in FIG. 6. Furthermore, when water 10 of the collection groove 27 enters into the drain pipe 7, the water 10 stored in the bent portion 71 of the drain pipe 7 will partly overflow beyond the bent portion 72 to the downstream side of the drain pipe 7. The overflowed water 10 is stored at the upstream side of the electromagnetic valve 8 as shown in FIG. 6. Namely, once the water level of the water stored in the bent portion 71 has reached the water level position 10*a*, the water 10 flowing into the drain pipe 7 from the collection groove 27 comes to increase the water level at the upstream side of the electromagnetic valve 8 while maintaining the constant water level position 10*a* of the water stored in the bent portion 71.

When the water 10 stored at the upstream side of the electromagnetic valve 8 increases, the water level will reach the water level position 10*b*. The control circuit 11 detects it based on the detection signal of the water level sensor 9. The control circuit 11 actuates the electromagnetic valve 8 to open the drain pipe 7. As a result, the water 10 stored at the upstream side of the electromagnetic valve 8 can be drained to the outside from the drain pipe 7. The water remaining in the bent portion 71 surely prevents the fuel mixture of air and hydrogen gas from leaking via the drain pipe 7 to the outside, after this fuel mixture is produced by the mixing element 2A. The drain pipe 7 has a simple arrangement having two bent portions 71 and 72 provided at intermediate portions thereof. This simple structure of the drain pipe 7 can surely prevent the fuel mixture of air and hydrogen gas from leaking out of the catalytic combustion heater 100, when the collected waterdrops is drained.

After a predetermined time (equivalent to the time required for fully draining the water stored at the upstream side of the electromagnetic valve 8) has passed, the control circuit 11 again actuates the electromagnetic valve 8 to close the drain pipe 7. The control circuit 11 alternately repeats the above-described open and close control of the drain pipe 7 by actuating the electromagnetic valve 8 based on the detection signal of the water level sensor 9. Thus, the second embodiment enables the control circuit 11 to drain the waterdrops at adequate timings even if the air containing waterdrops is introduced into the fuel mixture generating apparatus 1 during the operation of the fuel mixture generating apparatus 1.

Figure 7:
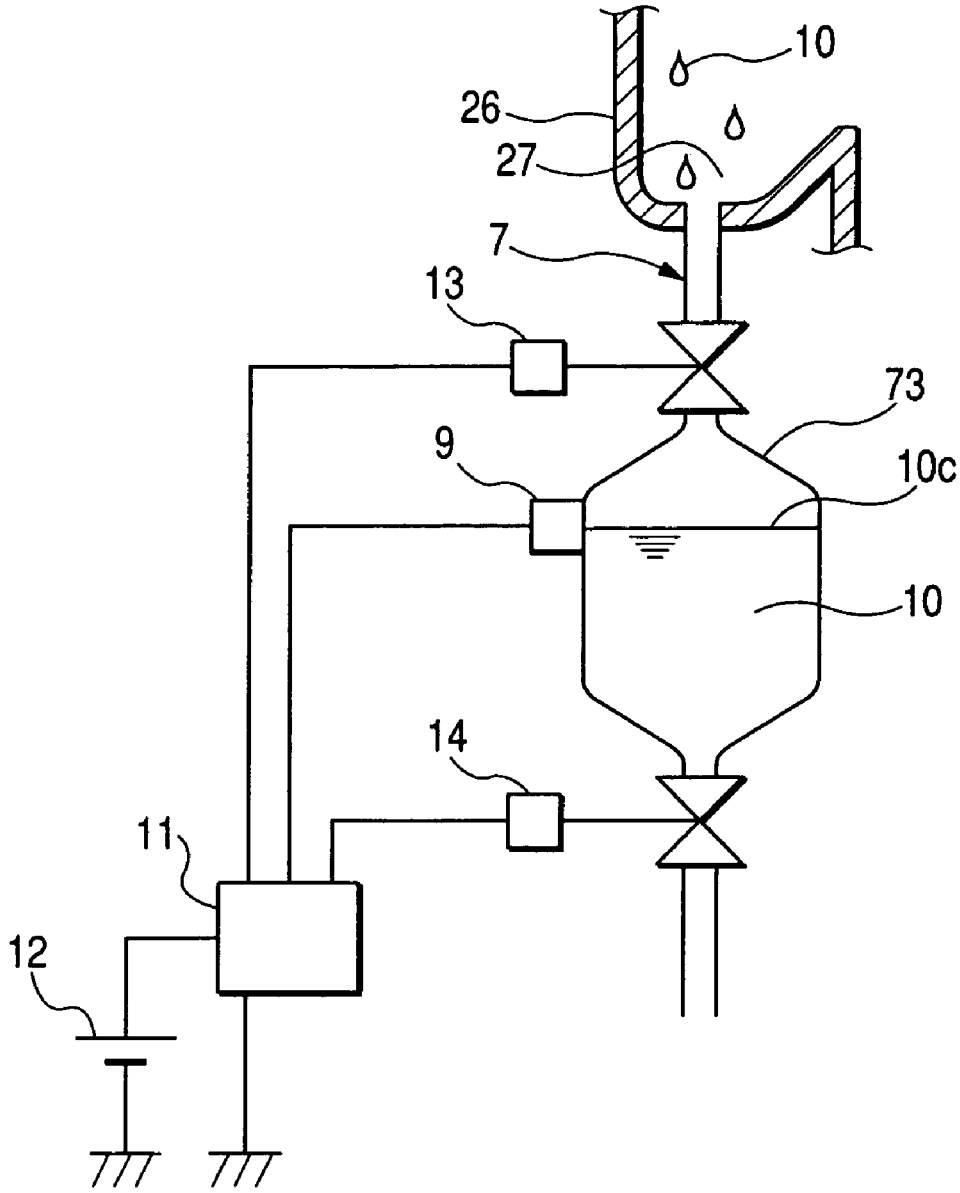
FIG. 7 is a partly cross-sectional view showing a modified example of the fuel mixture generating apparatus in accordance with the second embodiment of the present invention.

FIG. 7 is a partly cross-sectional view showing a modified example of the fuel mixture generating apparatus 1 in accordance with the second embodiment of the present invention. This modified example is different from the fuel mixture generating apparatus 1 of the second embodiment of the present invention in that the arrangement of the drain pipe 7 is modified. As shown in FIG. 7, a water reservoir 73 is provided at an intermediate portion of the drain pipe 7. Two electromagnetic valves 13 and 14 are provided at upstream and downstream sides of the water reservoir 73, respectively. Furthermore, the water level sensor 9 is provided at an upper portion of the water reservoir 73 to detect the water level position in the water reservoir 73. Two electromagnetic valves 13 and 14 and the water level sensor 9 are electrically connected to the control circuit 11.

Next, the drain action performed by the fuel mixture generating apparatus 1 in accordance with the modified example of the second embodiment of the present invention will be explained. When the fuel mixture generating apparatus 1 starts its operation, the electromagnetic valve 13 is opened and the electromagnetic valve 14 is closed. Furthermore, the water reservoir 73 is in an empty condition. During the operation of the fuel mixture generating apparatus 1, the waterdrops 10 contained in the air flow into in the collection groove 27 and then flow into the water reservoir 73 via the drain pipe 7. The water amount stored in the water reservoir 73 increases. When the water level reaches a water level position 10*c* shown in FIG. 7, the control circuit 11 closes the electromagnetic valve 13 and then opens the electromagnetic valve 14. The water stored in the water reservoir 73 is drained to the outside. An appropriate delay time, which is slightly longer than the time required for the electromagnetic valve 13 to surely close, is provided before the electromagnetic valve 14 is opened. This delay setting surely prevents the fuel mixture of air and hydrogen gas from leaking to the outside via the drain pipe 7.

When a predetermined time has passed after the electromagnetic valve 14 is opened, the control circuit 11 closes the electromagnetic valve 14 and then opens the electromagnetic valve 13. In this case, the predetermined time is slightly longer than the time required for fully draining the water stored in the water reservoir 73 to the outside. The waterdrops 10 collected in the collection groove 27 again flow into the water reservoir 73. An appropriate delay time, which is slightly longer than the time required for the electromagnetic valve 14 to surely close, is provided before the electromagnetic valve 13 is opened. This delay setting surely prevents the fuel mixture of air and hydrogen gas from leaking to the outside via the drain pipe 7.

According to the above-described fuel mixture generating apparatus 1 of the second embodiment of the present invention or its modified example, the fluorocarbon resin film is formed on the inner wall surface of the passage 22 and the surface of the fin 23. However, it is possible to use other method for giving the water repellency to the inner wall surface of the passage 22 and the surface of the fin 23. For example, at least one of the passage 22 and the fin 23 can be made of a material having excellent water repellency, such as fluororesin. In this case, the body 21 can be also made of a material having excellent water repellency. Or, the water repellent material can be used only to form the passages 22. Then, the passages 22 can be coupled and fixed to the body 21.

Furthermore, according to the fuel mixture generating apparatus 1 of the above-described second embodiment of the present invention and its modified example, the fluorocarbon resin film is provided on both of the inner wall surface of the passage 22 and the surface of the fin 23 to give excellent water repellency. However, it is possible to form the fluorocarbon resin film on either the inner wall surface of the passage 22 or the surface of the fin 23. Such modified arrangements can prevent the waterdrops contained in the air from reducing the substantial cross-sectional area of respective passages 22 in the mixing elements 2A. Thus, a required air flow rate will be surely obtained.

Furthermore, according to the above-described fuel mixture generating apparatus 1 of the first embodiment, the second embodiment, or its modified example, the body 21 of the static mixer 2 has a cylindrical shape with a bottom. However, the body 21 of the static mixer 2 can be formed into any other shape. For example, it is possible to use the cover 33 of the blower 3 to form the bottom of the body 21.

Furthermore, according to the above-described fuel mixture generating apparatus 1 of the first embodiment, the second embodiment, or its modified example, the blower 3 is a centrifugal blower. However, the blower 3 is not limited to a particular type. For example, an axial blower or a diagonal blower can be used as the blower 3. Although an electric motor is used for the blower 3, a hydraulic motor or any other driving source can be used for driving the blower 3.

Furthermore, the above-described fuel mixture generating apparatus 1 of the first embodiment, the second embodiment, or its modified example includes the separator 5 and the flow regulating plate 6. However, it is possible to remove at least one of the separator 5 and the flow regulating plate 6. In this case, the overall length L of the fuel mixture generating apparatus 1 can be shortened by disposing the blower 3 and the static mixer 2 in parallel with each other.

Furthermore, the above-described fuel mixture generating apparatus 1 of the first embodiment, the second embodiment, or its modified example uses the hydrogen gas as the first gas and the air as the second gas. However, it is possible to replace at least one of the first and second gases with other gas.

Furthermore, the first embodiment, the second embodiment, or its modified example is explained based on the fuel mixture generating apparatus 1 which is attached to the catalytic combustion heater 100 using the hydrogen gas as the fuel to produce the fuel mixture of hydrogen gas and air. However, the gas mixing apparatus of the present invention is not limited to the fuel mixture generating apparatus 1 incorporated into the catalytic combustion heater 100.

What is claimed is:

1. A gas mixing apparatus comprising:

mixing means having a gas inlet at one end side and a gas outlet at the other end side for producing a fuel mixture of a first gas and a second gas;

first gas supplying means for supplying said first gas to an outer side of said gas inlet of said mixing means; and second gas supplying means for supplying said second gas to an inner side of said gas inlet of said mixing means, wherein said mixing means includes a plurality of mixing elements disposed parallel to each other and arrayed annularly to define an inner cylindrical space surrounded by said mixing elements, each mixing element has stationary vanes disposed in a circular passage, said fuel mixture of said first gas and said second gas is produced from said gas outlet of said mixing means, said first gas supplying means is disposed outside said mixing means, and said second gas supplying means is accommodated entirely or partly in said inner cylindrical space of said mixing means.

2. The gas mixing apparatus in accordance with claim 1, wherein said second gas supplying means is a motor driven blower.

3. The gas mixing apparatus in accordance with claim 1, wherein said mixing means has a separating plate provided at said gas inlet for separating an introducing passage of said first gas from an introducing passage of said second gas.

4. The gas mixing apparatus in accordance with claim 1, wherein said mixing means has a flow regulating plate provided at a downstream portion of said gas outlet, said flow regulating plate includes numerous fine passages, and said fuel mixture exits out of said gas mixing apparatus through said flow regulating plate.

5. The gas mixing apparatus in accordance with claim 4, wherein said flow regulating plate is a porous air-permeable solid member.

6. The gas mixing apparatus in accordance with claim 1, wherein said first gas is hydrogen gas and said second gas is air.

7. The gas mixing apparatus in accordance with claim 1, wherein at least one of said passage and said stationary vanes has a water repellent surface.

8. The gas mixing apparatus in accordance with claim 7, further comprising collecting means provided in the vicinity of said gas outlet of said mixing means for collecting water, and draining means for draining the water collected by said collecting means to the outside.

* * * * *